US005161469A

United States Patent [19]

Hesch

[11] Patent Number: 5,161,469

[45] Date of Patent: Nov. 10, 1992

[54] ALL PURPOSE SPINE CAR CONTAINER FLOOR RESTRAINT

[75] Inventor: Harold E. Hesch, St. John, Ind.

[73] Assignee: Trinity Industries, Inc., Dallas, Tex.

[21] Appl. No.: 744,467

[22] Filed: Aug. 12, 1991

[51] Int. Cl.[5] ..... B61D 45/00

[52] U.S. Cl. ..... 105/404; 105/355; 105/411; 105/416; 105/419; 410/54

[58] Field of Search ..... 105/355, 396, 411, 404, 105/413, 416, 418, 419, 414, 3, 4.1; 410/52, 54, 56, 68, 58

[56] References Cited

U.S. PATENT DOCUMENTS

| | | | |
|---|---|---|---|
| 4,339,996 | 7/1982 | Brodeur et al. | 105/416 |
| 4,452,147 | 6/1984 | Jwuc | 105/419 |
| 4,516,506 | 5/1985 | Paton | 105/3 |
| 4,636,119 | 1/1987 | Terlecky | 410/54 |
| 4,686,907 | 8/1987 | Woodlam et al. | 410/56 |
| 4,751,882 | 6/1988 | Wheatley et al. | 105/416 |
| 4,917,019 | 4/1990 | Hesch et al. | 105/4.1 |
| 4,947,760 | 8/1990 | Dawson et al. | 105/3 |

FOREIGN PATENT DOCUMENTS

| | | | |
|---|---|---|---|
| 1805134 | 6/1969 | Fed. Rep. of Germany | 105/419 |
| 1294673 | 3/1987 | U.S.S.R. | 105/419 |

*Primary Examiner*—Robert J. Oberleitner
*Assistant Examiner*—Mark T. Le
*Attorney, Agent, or Firm*—Baker & Botts

[57] ABSTRACT

A container floor restraint for a freight rail car is provided. The car has a longitudinally extending center sill and a plurality of cross beams extending transversely thereof. The car further has a load supporting assembly at one end and a load supporting deck at the other. The container floor restraint includes a first pair of arms extending generally outwardly and perpendicularly from the center sill at a predetermined distance from the load supporting assembly, each arm being substantially opposed to one another. A second pair of arms extend generally outwardly and perpendicularly from the center sill spaced apart from the first pair of arms. The arms have outer ends extending substantially equidistantly from the center sill and are attached to first and second brace members. The brace members extend longitudinally alongside and generally parallel to the center sill. Additionally, channel braces are disposed longitudinally on the center sill spread from the first pair of arms and provide further restraint to a container floor.

17 Claims, 3 Drawing Sheets

ALL PURPOSE SPINE CAR CONTAINER FLOOR RESTRAINT

RELATED PATENT APPLICATION

This application is related to patent application Ser. No. 07/498,227, filed Mar. 23, 1990, now U.S. Pat. No. 5,052,868.

TECHNICAL FIELD OF THE INVENTION

This invention relates in general to the field of railway cars. More particularly, the present invention relates to an all purpose spine car container floor restraint.

BACKGROUND OF THE INVENTION

Railway spine cars have been used to carry freight containers and semitrailers. Spine cars generally have a platform formed by a center sill running longitudinally down its center line with a series of parallel crossbearers extending transversely of the sill. Because the spine car does not have a solid floor, the American Association of Railroads (AAR) requires restraints on spine cars sufficient to brace a failed container floor.

One response to AAR's requirement was to provide a set of parallel channels along the top of the center sill. This solution is far less than ideal however, because these channels interfere with semitrailer brake equipment and underslung refrigeration equipment. Another response to the AAR requirement was to provide outriggers on the cars and limit the use of these cars to container hauling only. Therefore, existing modifications to spine cars to provide a container floor restraint yielded structures that limit the application and usefulness of the spine cars.

Accordingly, it is desirable to construct a spine car with a structure that would provide a restraint to failed container floors as required by the AAR. In addition, when a semitrailer is mounted on the car, the container floor restraint must provide adequate clearance for trailer equipment. Because the weight of a railway car is at a premium, the container floor restraint structure must achieve its function while adding a minimal amount of weight to the weight of the car.

SUMMARY OF THE INVENTION

In accordance with the present invention, an all purpose spine car container floor restraint is provided which substantially eliminates or reduces disadvantages and problems associated with prior railway cars.

In one aspect of the present invention, a container floor restraint for a freight rail car is provided. The car has a longitudinally extending center sill and a plurality of cross beams extending transversely thereof. The car further has a load supporting assembly at one end and a load supporting deck at the other. The container floor restraint includes a first pair of arms extending generally outwardly and perpendicularly from the center sill at a predetermined distance from the load supporting assembly, each arm being substantially opposed to one another. A second pair of arms extend generally outwardly and perpendicularly from the center sill and are spaced apart from the first pair of arms. The arms have outer ends extending substantially equidistantly from the center sill and are attached to first and second brace members. The brace members extend longitudinally alongside and generally parallel to the center sill.

In another aspect of the present invention, a freight rail car is provided. The rail car comprises a longitudinally extending center sill between a first and second end of the car and a plurality of spaced apart spine members extending transversely of the center sill in a second half of the car adjacent to the second end. A foldable load supporting assembly is mounted substantially adjacent to the first end of the car as well as two load supporting decks mounted on both sides of the center sill adjacent to the second end of the car for receiving semitrailer wheels. An elongated channel member is mounted longitudinally on a top surface of the center sill for elevating the elevation of the center sill top surface. A first pair of arms which extend generally horizontally outwardly and perpendicularly from the center sill at a predetermined distance from the foldable load supporting assembly is provided. A second pair of arms extends generally horizontally outwardly and perpendicularly from the center sill and are spaced apart from the first pair of arms. The arms of the first and second pairs are mounted to substantially oppose one another. The free ends of the arms are attached to a first and second brace member extending longitudinally and substantially parallel to the center sill.

An important technical advantage of the present invention provides a container floor restraint which meets the requirements of the AAR. A further advantage of the present invention provides a construction that does not obstruct clearance required for semitrailer or rail car equipment. Additionally, because the weight of a railway car is at a premium, the container floor restraint achieves its function while adding a minimal amount of weight to the car.

BRIEF DESCRIPTION OF THE DRAWINGS

For a better understanding of the present invention, reference may be made to the accompanying drawings, in which.

DETAILED DESCRIPTION OF THE INVENTION

Figure 1:
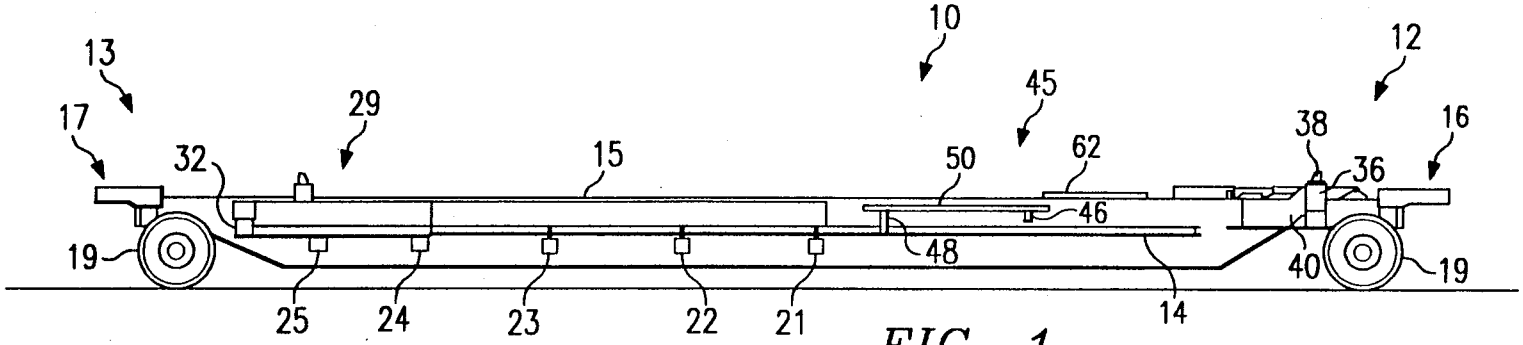
FIG. 1 is an elevational side view of an intermediate spine car incorporating a preferred embodiment of the container floor restraint of the present invention.
Figure 2:
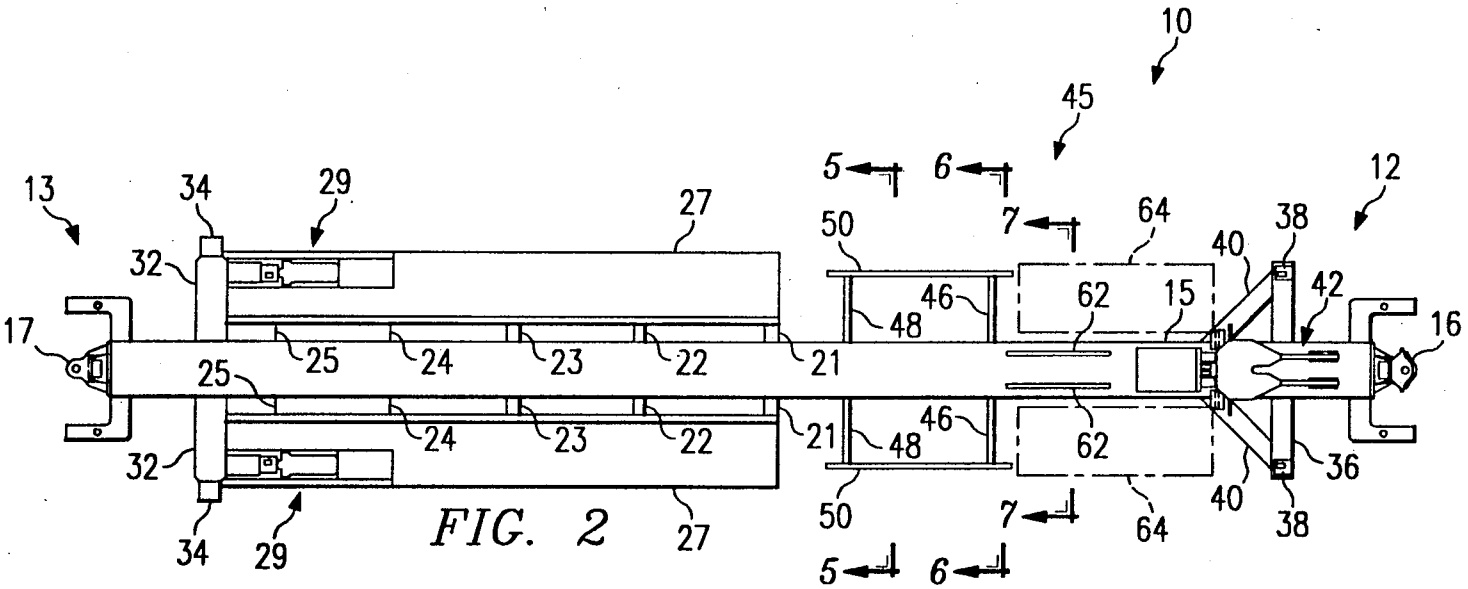
FIG. 2 is a top view of the intermediate spine car.

With reference to the drawings, FIGS. 1 and 2 illustrate an intermediate railway car unit 10 having first and second ends 12 and 13 respectively and a longitudinally extending center sill 15. The car unit 10 forms part of a five-unit car (not shown). Center sill 15 generally supports the load placed on the car, such as a container or a semitrailer, and withstands towing loads. Ends 12 and 13 of car unit 10 include couplers 16 and 17 for joining car unit 10 with other railway car units in a train (not shown). Wheels 19 which form part of a truck and swivel coupling that provide common support for adjacent units in the car as is well known in the art. The wheels 19 support car unit 10 at both ends 12 and 13. An elongated reinforcing beam 14 is further coupled longitudinally to the substantially vertical side walls of center sill 15 to strengthen the structure thereof.

Conceptually, car unit 10 may be divided into two halves, a first half from first end 12 to an imaginary midpoint, and a second half from generally the mid point to second end 13. In the second half of car unit 10, a plurality of pairs of transverse cross beams 21–25 are connected to the side walls of center sill 15 at respective sites substantially equidistance from one another. Two decks or platforms 27 are mounted on cross beams 21–25 on both sides of center sill 15 for receiving semitrailer wheels. Container locking assemblies 29 are folded into platforms 27 when not in use, but project through openings in platforms 27 when carrying a container. Opposing bolsters 32 are attached to the center sill side walls and extend horizontally and outwardly therefrom.

In generally the first half of car unit 10, crossbearers 36 are attached to center sill side walls adjacent first end 12. Crossbearers 36 include container locks 38 on their free ends and are braced by beams 40. Beams 40 extend diagonally from the free ends of crossbearers 36 to center sill 15 and connect therewith. A foldable fifth wheel plate assembly or semitrailer coupler 42 is accommodated in a recess or depression formed by crossbearers 36, beams 40 and center sill 15. Coupler 42 is raised into an operative position when car unit 10 is carrying a semitrailer. Car unit 10 described above and shown in FIGS. 1 and 2 is an intermediate car to be connected between two end cars, which are described below in conjunction with FIGS. 3 and 4. Related patent application Ser. No. 07/498,227, filed Mar. 23, 1990, now U.S. Pat. No. 5,052,868 and entitled "All Purpose Car" may be consulted for more detailed description of car unit 10.

Intermediate car unit 10 further comprises a container floor restraint, indicated generally at 45 and constructed in accordance with the preferred embodiment of the present invention. Container floor restraint 45 includes a first pair of outwardly extending arms or beams 46. Arms 46 are attached to the side walls of center sill 15 opposite each other and extending substantially horizontally and perpendicularly therefrom. A second pair of outwardly extending arms 48 are attached to the center sill side walls spaced from the first pair of arms 46. The free ends of each pair of arms 46 and 48 extend equidistantly outward from center sill 15. Braces 50 are mounted on the free ends of arms 46 and 48 on both sides of center sill 15. The ends of braces 50 generally extend longitudinally beyond the free ends of arms 46 and 48. Arms 46 and 48 and braces 50 in effect form two rectangular retaining brackets, one on each side of center sill 15.

Figure 4:
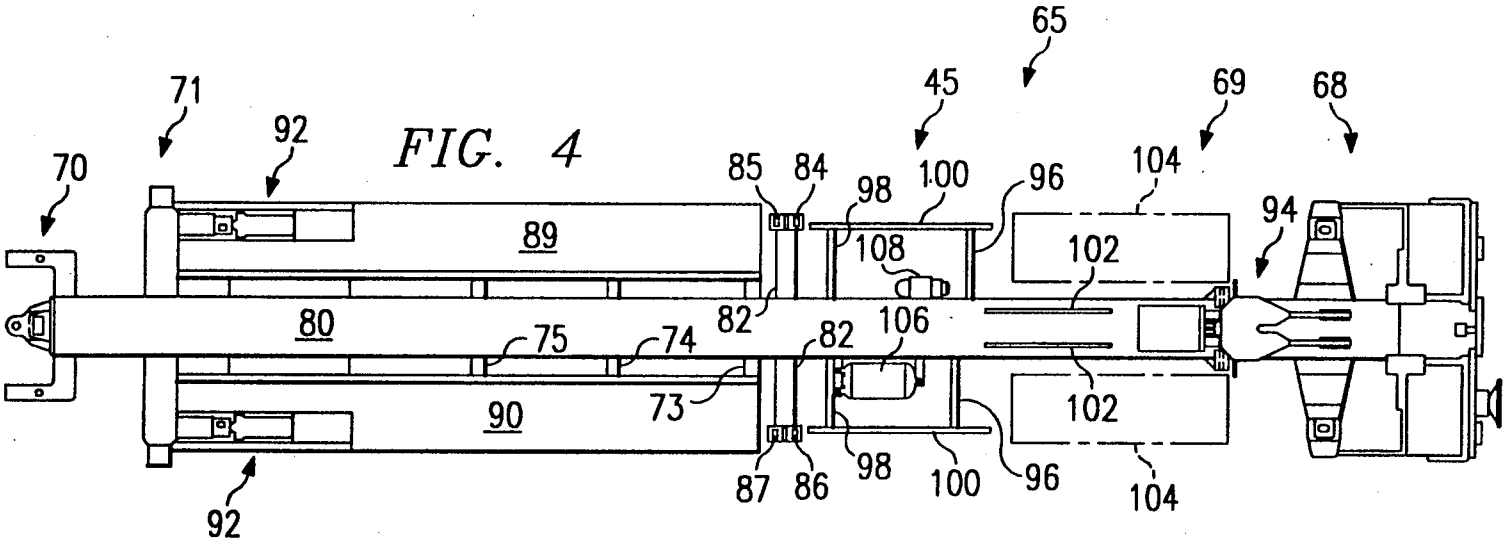
FIG. 4 is a top view of the end spine car.
Figure 5:
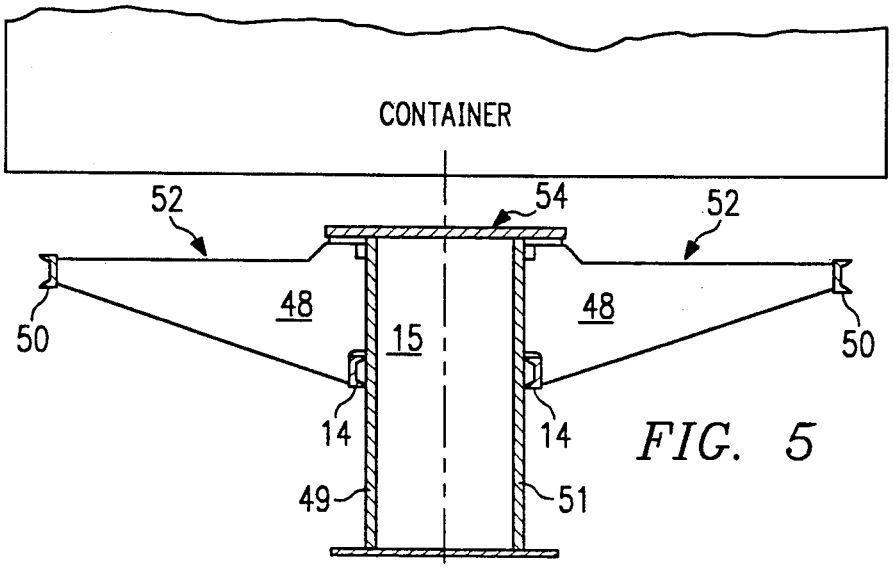
FIG. 5 is a cross-sectional view taken substantially along sectional lines 5—5 in FIGS. 2 and 4.

Referring to FIG. 5, a cross-sectional view of arms 48 and braces 50 taken along lines 5—5 of FIGS. 2 and 4 is shown. Arms 48 are generally triangular in shape with one side attached to the center sill side walls 49 and 51. A notch is formed therein to accommodate and be attached to reinforcing beam 14. A second side of arms 48 forms the top surface 52 thereof. Top surface 52 is preferably at an elevation substantially below the top surface 54 of center sill 15. A portion of a container is shown to indicate its positioning and relative elevation with respect to center sill 15 and arms 48. Braces 50 are preferably U-shaped beams attached to arms 48 as shown.

Figure 6:
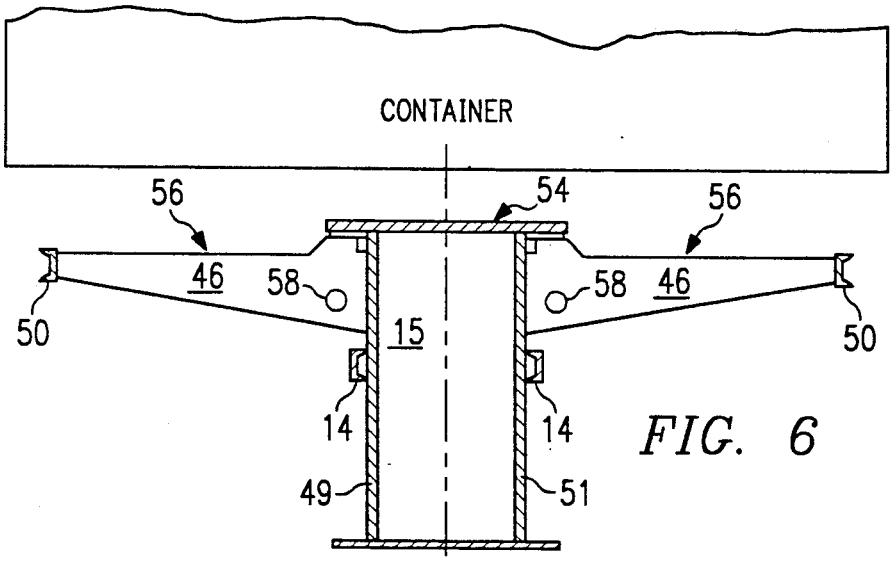
FIG. 6 is a cross-sectional view taken substantially along sectional lines 6—6 in FIGS. 2 and 4.

Referring presently to FIG. 6, a cross-sectional view showing center sill 15 and arms 46 taken along lines 6—6 of FIGS. 2 and 4 is shown. The second pair of arms 46 extends from the side walls 49 and 51 of center sill 15. The top surface 56 thereof lies generally below the elevation of center sill top surface 54 but is generally at the same elevation as that of arms 48. The outer free ends of arms 46 are attached to braces 50. Arms 46 are shown having orifices 58, but such features are not imperative to the operations of the present invention. A portion of the container load is also shown to indicate its relative position with respect to arms 46.

Returning to FIGS. 1 and 2, positioned immediately adjacent to the first pair of arms 46 are a pair of channel braces 62 mounted on top of center sill 15. The length of channel braces 62 is such that they do not interfere with the operations of foldable fifth wheel assembly 42 and any other equipment on the semitrailer load. Areas 64 alongside center sill 15 and generally bounded by arms 46, crossbearers 36 and beams 40 must remain free of obstructions for clearance of semitrailer landing gears (not shown).

Figure 7:
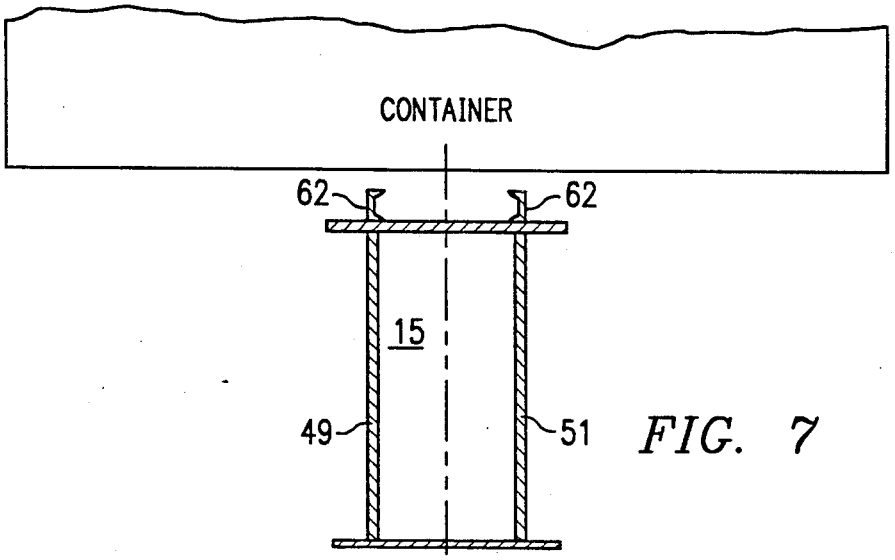
FIG. 7 is a cross-sectional view taken substantially along sectional lines 7—7 in FIGS. 2 and 4.

Referring to FIG. 7, a cross-sectional view showing center sill 15 and channel braces 62 is shown. Channel braces 62 are each U-shaped with the open end mounted toward the center line of center sill 15. Constructed in this manner, channel braces 62 effectively raise the elevation of a portion of the top surface of center sill 15 toward the floor of a container load. In the preferred embodiment, channel braces 62 add a three inch height to center sill 15.

Figure 3:
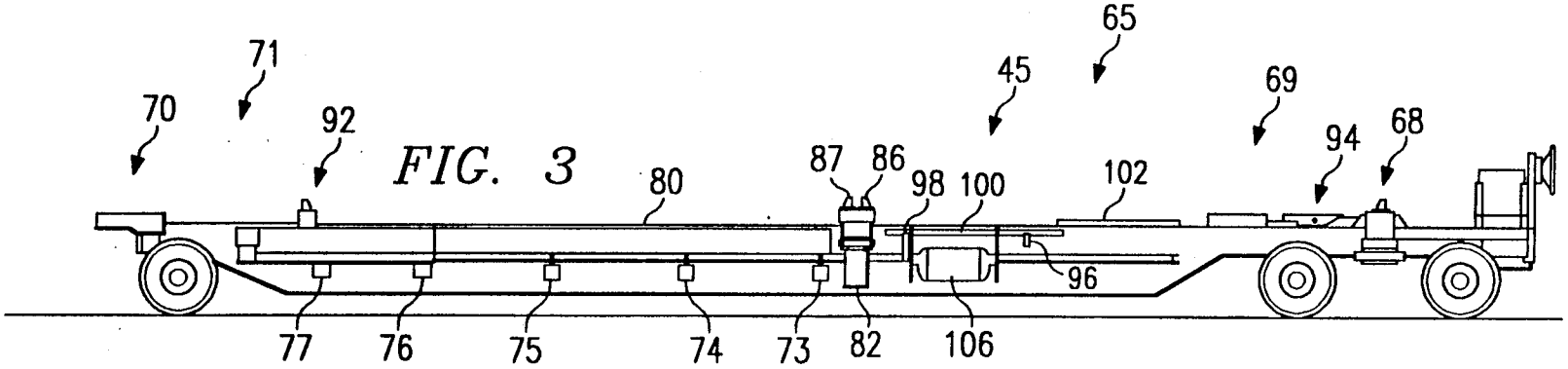
FIG. 3 is an elevational side view of an end spine car incorporating the preferred embodiment of the container floor restraint of the present invention.

Referring to FIGS. 3 and 4, the application of container floor restraint 45 to an end railway car unit 65 is shown. End car unit 65 has an end frame assembly 68 and a standard railway coupler (not shown) at a first end 69 and a coupler assembly 70 at a second end 71. A plurality of cross beams 73–77 span transversely a center sill 80 in a second half of car unit 65 generally between a center crossbearer 82 and second end 71. Center crossbearer 82 is mounted extending from center sill 80 at approximately the midpoint between ends 69 and 71 and has container locks 84–87 disposed on its free ends. Mounted and supported on top of cross beams 73–77 are platform 89 and 90 for receiving semitrailer wheels. Locking assemblies 92 are arranged and stowed away in platform 89 and 90 when not in use, as shown. Near first end 69 of car unit 65 and end frame assembly 68 is a foldable wheel assembly 94.

Disposed between center crossbearer 82 and foldable wheel assembly 94 is container floor restraint 45. Container floor restraint 45 for an end car unit 65 is substantially the same as that for an intermediate car unit 10 as described above. It includes a first pair of arms 96, a second pair of arms 98 extending outwardly from center sill 80, and braces 100 attached to the free ends of arms 96 and 98. A pair of channel braces 102 are mounted on top of center sill 80 and disposed between arms 96 and foldable fifth wheel assembly 94. Clearance area 104 is further provided for the semitrailer landing gear. As shown, arms 96 and 98 are mounted on center sill 80 as so not to interfere with the structure and operations of an air brake reservoir 106 and an air brake control valve 108. In order to accommodate control valve 108 and enable it to be replaced when necessary, the left arm of arms 96 is required to be offset forward slightly from the other arm. The offset is approximately seven inches in the arrangement shown. Cross-sectional views of arms 96, 98, braces 100, and channel braces 102 are shown in FIGS. 5–7, which are identified by reference numerals of FIGS. 1 and 2, but are equally applicable to FIGS. 3 and 4. Related patent application Ser. No. 07/498,227, filed Mar. 23, 1990, now U.S. Pat. No. 5,052,868, and entitled "All Purpose Car" may be consulted for a more detailed description of end car unit 65.

Although the present invention has been described in detail, it should be understood that various changes, substitutions and alterations can be made thereto without departing from the spirit and scope of the present invention as defined by the appended claims.

What is claimed is:

1. A freight rail car having first and second ends, a longitudinally extending center sill between said first and second ends, and at least one structural member extending transversely of said center sill, said center sill having a top surface generally lying in a horizontal plane, said first end having a load supporting assembly including a foldable wheel assembly, said second end having a load supporting deck, the car comprising:

a first pair of arms each extending generally horizontally outwardly from said center sill at a predetermined distance from said load supporting assembly, said arms being substantially opposed to one another;

a second pair of arms each extending generally horizontally outwardly from said center sill, spaced from said first pair of arms, said arms being substantially opposed to one another, said first and second pairs of arms being substantially below said horizontal plane formed by said center sill top surface, and said arms having outer ends extending substantially equidistantly from said center sill;

first and second brace members each firmly attached to said outer ends of said first and second pairs of said arms, each said first and second brace member extending longitudinally and being substantially parallel to said center sill; and means for elevating a selected top surface portion of said center sill, said elevating means being disposed between said foldable wheel assembly and said first pair of arms.

2. The car, as set forth in claim 1, wherein said elevating means comprises at least one longitudinally extending member disposed on and firmly attached to said top surface of said center sill.

3. The car, as set forth in claim 1, further comprising first and second channel members each having a predetermined length and mounted longitudinally on said center sill at a second predetermined distance from said load supporting assembly, said channel members being substantially parallel and spaced from one another.

4. The car, as set forth in claim 1, wherein the car further transports semitrailers having a landing gear, said first and second pairs of arms being located at said predetermined distance from said load supporting assembly to provide clearance for said landing gear.

5. The car, as set forth in claim 1, wherein said center sill includes two substantially vertical and parallel side walls, said first pair of arms each being substantially triangular in shape, one side of said triangular shape forming a top surface of said arm and another side joining said side wall of said center sill.

6. The car, as set forth in claim 1, wherein said center sill includes two substantially vertical and parallel side walls, said second pair of arms each being substantially triangular in shape, one side of said arm forming a top horizontal surface of said arm and another side joining said side wall of said center sill.

7. The car, as set forth in claim 6, wherein the car has a brake apparatus mounted to said side wall of said center sill, one arm of said first pair of arms is offset from said other opposing arm to provide clearance for said brake apparatus.

8. A freight rail car having a first and second ends and a longitudinally extending center sill, said center sill having a top surface generally lying in a horizontal plane, the car further having a hitch supporting assembly at a predetermined distance from said first end and a pair of platforms for receiving semitrailer wheels located at each side of said center sill a second predetermined distance from said second end, the car comprising:

a first pair of arms each extending substantially horizontally, outwardly from each side of said center sill at a first predetermined distance from said hitch supporting assembly, said first pair of arms substantially opposing one another and having outer ends extending substantially equidistantly from said center sill;

a second pair of arms each extending horizontally and outwardly from each side of said center sill spaced apart from said first pair of arms and at a second predetermined distance from said platforms, said second pair of arms substantially opposing one another, said first and second pair of arms having outer ends extending equidistantly from said center sill; and a center brace member mounted longitudinally on said center sill between said hitch supporting assembly and said first and second pairs of arms for elevating a portion of the top surface of said center sill.

9. The car, as set forth in claim 8, wherein said center sill has two substantially vertical and parallel side walls, each arm of said first and second pairs of arms further include:

a triangular crossbearer having three sides, one side being attached to said side wall of said center sill, another side forming a top surface of said arm and at substantially the same elevation as top surface of said center sill; and a first and second reinforcing brace coupled to said outer ends of said first and second pairs of arms respectively and connecting said outer ends on each side of said center sill, said first and second reinforcing braces being substantially parallel with said center sill.

10. The car, as set forth in claim 8, wherein said center brace member includes a first and second channel member having a predetermined length and mounted longitudinally on said center sill at a third predetermined distance from said hitch supporting assembly, said channel members being substantially parallel and spaced apart from one another.

11. The car, as set forth in claim 8, wherein the car further transports semitrailers having a landing gear, said first and second arms being located at said first predetermined distance from said hitch supporting assembly to provide clearance for said landing gear.

12. The car, as set forth in claim 8, wherein said first pair of arms are slightly offset from one another.

13. A freight rail car comprising:

a center sill extending longitudinally between a first and second ends of said car;

a plurality of spaced apart spine members extending transversely of said center sill in a second half of said car adjacent to said second end;

a foldable load supporting assembly mounted substantially adjacent to said first end of the car;

two load supporting decks mounted on both sides of said center sill adjacent to said second end of the car for receiving semitrailer wheels;

an elongated channel member mounted longitudinally on a top surface of said center sill for elevating the elevation of said center sill top surface;

a first pair of arms each extending generally horizontally outwardly and perpendicularly from said center sill at a predetermined distance from said foldable load supporting assembly and being in a first half of the car adjacent said first end, each arm being substantially opposed to one another but being slightly offset from one another;

a second pair of arms each extending generally horizontally outwardly and perpendicularly from said center sill spaced apart from said first pair of arms, each arm being substantially opposed to one another, said first and second pairs of arms being substantially below the elevation of said center sill top surface, and said first and second pairs of arms having outer ends extending substantially equidistantly from said center sill; and first and second brace members each firmly attached to said outer ends of said first and second pairs of said arms, each said first and second brace member extending longitudinally and being substantially parallel to said center sill.

14. The car, as set forth in claim 13, wherein the car further transports semitrailers having a landing gear, said first and second pairs of arms being located at said predetermined distance from said foldable load supporting assembly to provide clearance for said landing gear.

15. The car, as set forth in claim 13, wherein said center sill includes two substantially vertical and parallel side walls, said first pair of arms each being substantially triangular in shape, one side of said triangular shape forming a top surface of said arm and another side joining said side wall of said center sill.

16. The car, as set forth in claim 13, wherein said center sill includes two substantially vertical and parallel side walls, said second pair of arms each being substantially triangular in shape, one side of said arm forming a top horizontal surface of said arm and another side joining said side wall of said center sill.

17. The car, as set forth in claim 13, wherein said elongated channel member comprises a pair of beams having U-shaped cross-sections.

* * * * *